US006592414B2

(12) United States Patent
Mineno et al.

(10) Patent No.: US 6,592,414 B2
(45) Date of Patent: Jul. 15, 2003

(54) STEERING STRUCTURE OF AN OUTBOARD MOTOR

(75) Inventors: Kazuo Mineno, Shizuoka (JP); Junzo Ueda, Shizuoka (JP); Hirotoshi Sakaguchi, Shizuoka (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 0 days.

(21) Appl. No.: 09/988,604

(22) Filed: Nov. 20, 2001

(65) Prior Publication Data

US 2002/0081918 A1 Jun. 27, 2002

(30) Foreign Application Priority Data

Dec. 21, 2000 (JP) ..... 2000-389234

(51) Int. Cl.[7] ..... B63H 5/20
(52) U.S. Cl. ..... 440/53; 440/52
(58) Field of Search ..... 440/52, 58, 60, 440/61, 53

(56) References Cited

U.S. PATENT DOCUMENTS 6,138,596 A * 10/2000 Gonring et al. ..... 114/144 R

FOREIGN PATENT DOCUMENTS

JP 2-185893 7/1990

* cited by examiner

*Primary Examiner*—Jesus D. Sotelo
(74) *Attorney, Agent, or Firm*—Greenblum & Bernstein, P.L.C.

(57) ABSTRACT

A steering structure of an outboard motor is provided to have high reliability without functional deterioration. The steering structure includes a tilting shaft provided on a bracket device of the outboard motor to pivotally support the outboard motor in such a manner that the outboard motor can tilt vertically. A steering damper is disposed on the outboard motor, wherein the steering damper includes a damper cylinder and a piston rod that extends inside the damper cylinder and protrudes outwardly from the damper cylinder in a transverse direction. Openings at opposite ends of the damper cylinder are closed by a piston stopper, which slidably supports the piston rod and maintains the inside of the damper cylinder fluidtight, to form a fluid chamber. A damper piston is provided at the central portion of the piston rod in the fluid chamber to partition the fluid chamber into right and left chambers. The right and left fluid chambers are communicated with each other by a bypass pipe, and a throttle valve is disposed intermediate the ends of the bypass pipe.

33 Claims, 7 Drawing Sheets

STEERING STRUCTURE OF AN OUTBOARD MOTOR

BACKGROUND OF THE INVENTION

1. Field of the Invention

The present invention relates to a steering structure of an outboard motor.

2. Description of the Background Information

As a method for steering a vessel with an outboard motor, a system is known in which a steersman swings a steering handle provided at the front portion of the outboard motor to the right and left, thereby the outboard motor is steered to the right and left.

There is another example of such a steering structure, wherein a steering adjuster 1 as shown in FIG. 7 is mounted on an outboard motor 2 to prevent shocks to the outboard motor 2 from being transmitted to the steersman during steering. The steering adjuster 1 includes a rod-shaped adjuster arm 4, an end of which is rotatably attached to steering bracket 3 of the outboard motor 2 to which the steering handle is attached, a resistance nut 7, which is provided on clamp bracket 6 for mounting the outboard motor 2 to the vessel body via swivel bracket 5, and an adjuster shift 8 slidably inserted into the tightening portion 7*a* of the resistance nut 7, and the other end of the adjuster arm 4 is rotatably attached to the free end of the adjuster shaft 8.

A winged screw 9 on the tightening portion 7*a* is tightened to impart resistance to the sliding of the adjuster shaft 8 in order to absorb shocks exerted to the outboard motor 2.

The steering adjuster having the above structure becomes unable to fulfill inherent functions if the resistance nut exhibits less resistance when oil is adhered to the tightening portion at which resistance is generated, and when vibrations from the engine loosen the winged screw.

SUMMARY OF THE INVENTION

The present invention is made in view of the above, and an object of the present invention is to provide a steering structure of an outboard motor, which has no deterioration in functions and is highly reliable.

In order to solve the above problems, according to a first aspect of the invention, a steering structure of an outboard motor mounted on a vessel body via a bracket device and rendered steerable in a transverse direction of the vessel body by a steering handle is provided. The steering structure includes a tilting shaft positioned on the bracket device for pivotally supporting the outboard motor in such a manner that the outboard motor is vertically tilted. A steering damper is disposed in front of the outboard motor, below a steering bracket having a steering handle-mounting portion, and in front of the bracket device. The steering damper includes a damper cylinder positioned parallel to the tilting shaft and a piston rod that extends through the inside of the damper cylinder, extends parallel to the tilting shaft, and protrudes outwardly from the damper cylinder. Openings at opposite ends of the damper cylinder are closed by a piston stopper, which slidably supports the piston rod and maintains the inside of the damper cylinder fluidtight, to for a fluid chamber inside the damper cylinder. A damper piston for partitioning the oil chamber into right and left chambers is provided intermediate the ends of the piston rod positioned inside the fluid chamber. The right and left fluid chambers are intercommunicated by a bypass pipe, and a throttle valve is provided on the bypass pipe.

According to a second aspect of the invention, the damper cylinder and the steering bracket are linked to each other by a steering arm.

According to a third aspect of the invention, the throttle valve is disposed in front of the damper cylinder. The throttle valve is provided with an adjusting knob for varying a flow resistance value, the adjusting knob being disposed in a condition where the front surface thereof is perpendicular to a shaft portion thereof.

According to a fourth aspect of the invention, the throttle valve is disposed on the centerline of the forward direction of the outboard motor.

According to a fifth aspect of the invention, the throttle valve is disposed above the damper cylinder.

According to a sixth aspect of the invention, each end of the piston rod is fixed to one end of each of a pair of horizontally disposed right and left piston rod holders, the other ends of the pair of piston rod holders are disposed at opposite sides of the bracket device, and the piston rod holders and the bracket device are connected together on the tilting shaft.

As described above, the present invention provides a steering structure of an outboard motor mounted on a vessel body via a bracket device and made steerable to the right and left by means of a steering handle. The steering structure includes a tilting shaft provided on the bracket device to pivotally support the outboard motor in such a manner that the outboard motor can vertically tilt. A steering damper is disposed in front of the outboard motor, below a steering bracket having a steering handle-mounting portion, and in front of the bracket device. The steering damper includes a damper cylinder disposed parallel to the tilting shaft and a piston rod that extends inside the damper cylinder, extends parallel to the tilting shaft, and protrudes outwardly from the damper cylinder in the transverse direction. Openings at opposite ends of the damper cylinder are closed by a piston stopper, which slidably supports the piston rod and maintains the inside of the damper cylinder fluidtight, to form a fluid chamber inside the damper cylinder. A damper piston for partitioning the fluid chamber into right and left chambers is provided intermediate the ends of the piston rod positioned inside the fluid chamber. The right and left fluid chambers are intercommunicated by a bypass pipe, and a throttle valve is provided on the bypass pipe. According to this construction, the steering damper isolates a steersman from shocks that are unexpectedly exerted on the outboard motor during steering of the outboard motor. In addition, the damper performance is improved so as to be highly reliable.

The damper cylinder and the steering bracket are linked with each other through the steering arm. This construction simplifies the structure of the outboard motor.

Furthermore, the throttle valve is disposed on the centerline of the forward direction of the outboard motor in front of and above the damper cylinder. The throttle valve is provided with an adjusting knob for varying a flow resistance value. The adjusting knob is disposed so that the front surface is vertical. Such a construction allows the damper performance to be set according to a preference of the steersman, improves steerability, and makes adjustments of the throttle valve easy.

Moreover, each end of the piston rod is fixed to one end of a pair of horizontally extending piston rod holders, while the other ends of the piston rod holders are disposed on opposite sides of the bracket device. The piston rod holders and the bracket device are connected together on the tilting shaft. This construction makes the entire device compact and simplifies the structure.

In another aspect of the present invention, a damping structure is provided for a steering structure of an outboard motor, the steering structure including a steering handle mounting portion, and the outboard motor including a mounting bracket for mounting the outboard motor on a vessel. The damping structure includes a double acting fluid damper operatively connected between the steering handle mounting portion and the mounting bracket, whereby the damper permits normal steering of the vessel by pivoting of the motor but alleviates and absorbs shocks that are exerted on the motor so that such shocks will not be transmitted to a steersman.

In a further aspect of the present invention, the double acting fluid damper includes a damper cylinder having openings at opposite ends thereof, and a piston rod that extends through the inside of the damper cylinder and protrudes outwardly from the damper cylinder at opposite ends thereof. The openings of the damper cylinder are each closed by a piston stopper, which slidably supports the piston rod and maintains the inside of the damper cylinder fluidtight thereby forming a fluid chamber inside the damper cylinder, and a damper piston that partitions the fluid chamber into right and left fluid chambers is provided intermediate the ends of the piston rod positioned inside the fluid chamber. A fluid provided within the fluid chamber, and a bypass pipe interconnects the right and left fluid chambers to permit fluid to pass between the right and left fluid chambers.

In another aspect of the present invention, a throttle valve may be provided on the bypass pipe to regulate the flow of fluid between the chambers. Additionally, the throttle valve may be disposed in front of the damper cylinder, and the throttle valve may be provided with an adjusting knob for varying a flow resistance value, the adjusting knob being disposed in a condition where a front surface thereof extends generally vertically. Also, the throttle valve may be disposed above the damper cylinder.

In a further aspect of the present invention, each end of the piston rod is fixed to one end of a pair of horizontally disposed right and left piston rod holders, and the other ends of the pair of piston rod holders are disposed at opposite sides of the mounting bracket.

In other aspects of the present invention, the damper fluid may include one of a liquid and a gas. Furthermore, the liquid may be oil, and the gas may be nitrogen.

According to another aspect of the present invention, a steering structure of an outboard motor mountable on a vessel body via a bracket device and rendered steerable in a transverse direction of the vessel body by a steering handle. The steering structure includes a tilting shaft positioned on the bracket device for pivotally supporting the outboard motor in a manner such that the outboard motor is vertically tiltable, and a steering damper disposed in front of the outboard motor, below a steering bracket having a steering handle-mounting portion, and in front of the bracket device. The steering damper includes a damper cylinder having openings at opposite ends thereof, a piston rod extending through the inside of the damper cylinder and protruding outwardly from the damper cylinder at opposite ends thereof. The openings of the damper cylinder are each closed by a piston stopper, which slidably supports the piston rod and maintains the inside of the damper cylinder fluidtight to form a fluid chamber inside the damper cylinder, and a damper piston that partitions the fluid chamber into right and left fluid chambers is provided intermediate the ends of the piston rod positioned inside the fluid chamber. A fluid provided within the fluid chamber, and a bypass pipe interconnects the right and left fluid chambers to permit fluid to pass between the right and left fluid chambers.

A throttle valve may be provided on the bypass pipe to regulate the flow of fluid between the chambers, and the throttle valve may be disposed in front of the damper cylinder. The throttle valve may also be provided with an adjusting knob for varying a flow resistance value, the adjusting knob being disposed in a condition where a front surface thereof is generally vertical. The throttle valve may be disposed on the centerline of a forward direction of the outboard motor, and the throttle valve may be disposed above the damper cylinder. Furthermore, the damper cylinder and the steering bracket may be linked together through a steering arm.

In another aspect of the present invention, each end of the piston rod may be fixed to one end of a pair of horizontally disposed right and left piston rod holders, the other ends of the pair of piston rod holders are disposed at opposite sides of the bracket device, and the piston rod holders and the bracket device are connected together on the tilting shaft.

In further aspects of the present invention, the fluid may include one of a liquid and a gas. The liquid may be oil, and the gas may be nitrogen.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Embodiments of the present invention will now be described with reference to the drawings.

Figure 1:
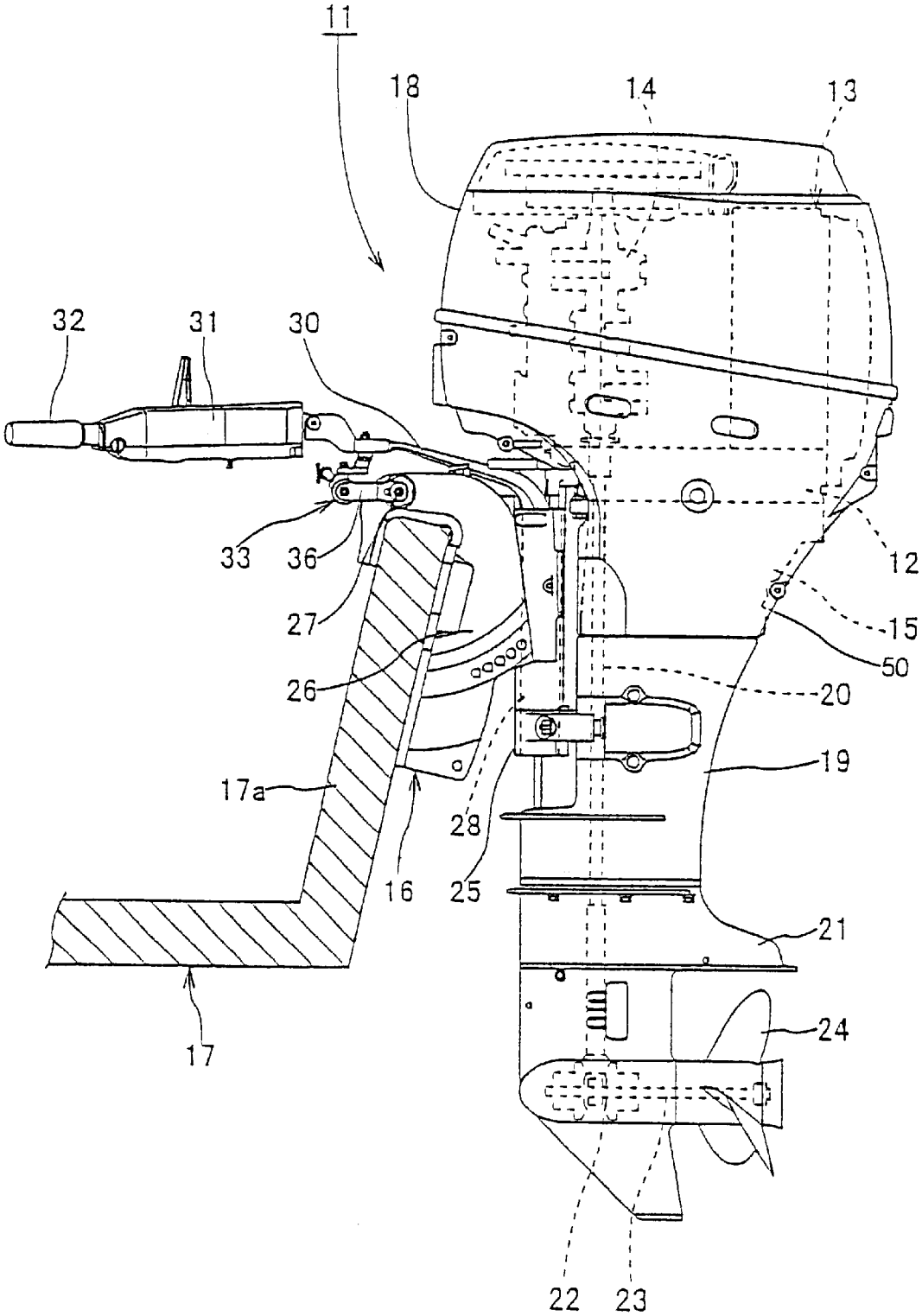
FIG. 1 is a left side view showing an embodiment of the steering structure of an outboard motor according to the present invention.
Figure 2:
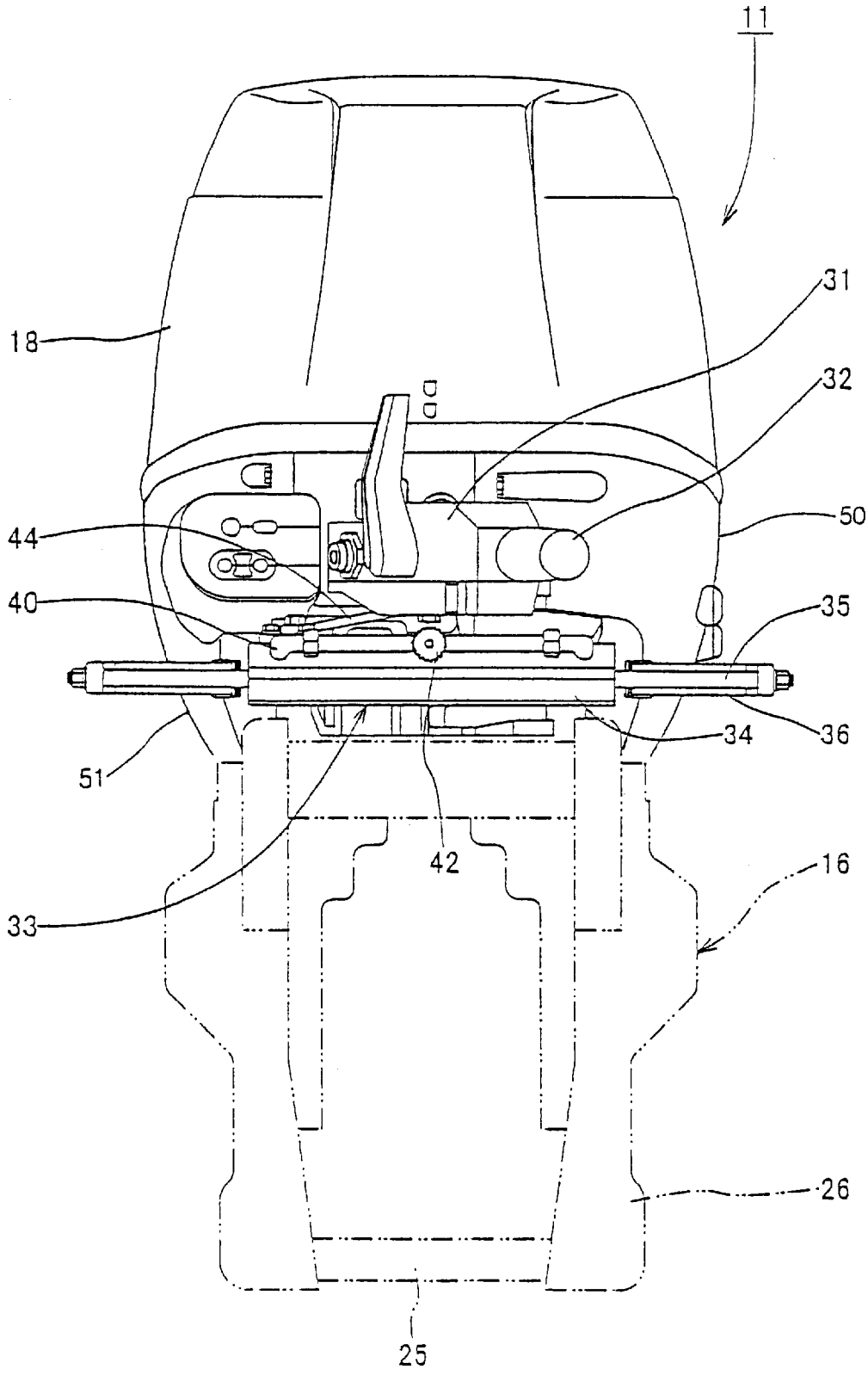
FIG. 2 is a front view showing the outboard motor of FIG. 1.
Figure 3:
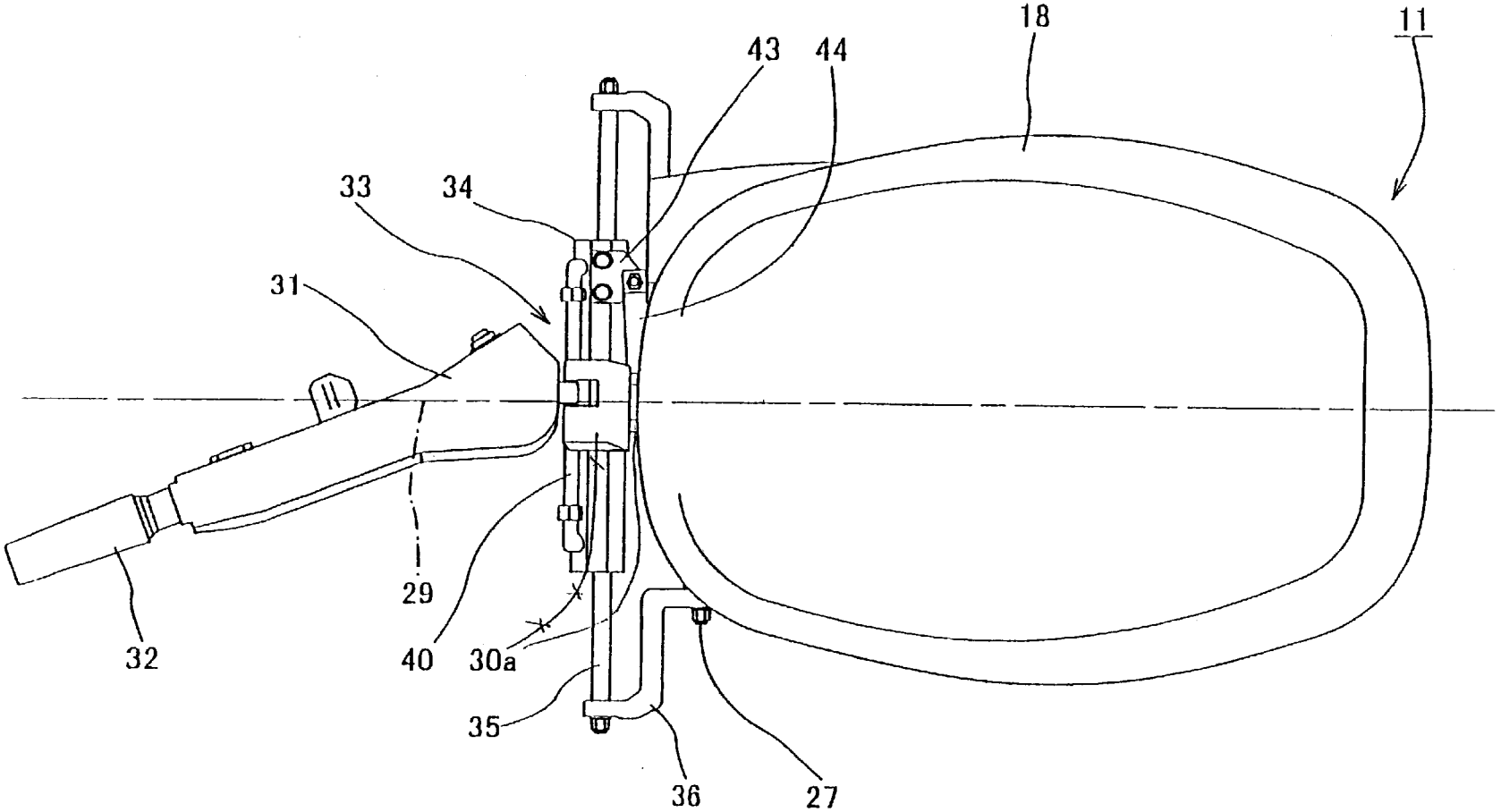
FIG. 3 is a top view illustrating the outboard motor of FIG. 1.

FIG. 1 is a left side view illustrating an outboard motor according to the present invention. FIG. 2 is a front view illustrating the outboard motor. FIG. 3 is a top view showing the outboard motor. As shown in FIGS. 1–3, the outboard motor 11 includes an engine holder 12 in which an engine 13 is mounted on the engine holder 12. The engine 13 is a vertical type engine having a crankshaft 14 substantially vertically disposed inside. An oil pan 15 is positioned below the engine holder 12, and for example, bracket device 16 is mounted on the engine holder 12, and the outboard motor 11 is mounted to transom 17*a* of the vessel body 17 via this bracket device 16. Furthermore, the periphery of the engine 13, engine holder 12, and oil pan 15 of this outboard motor 11 is covered by engine cover 18 and side covers 50 and 51.

A drive shaft housing 19 is located below the oil pan 15. A substantially vertically extending drive shaft 20 is provided inside the engine holder 12, the oil pan 15, and the drive shaft housing 19. The upper end of the drive shaft 20 is connected to the lower end of the crankshaft 14. The drive shaft 20 extends downward inside the drive shaft housing 19 so as to drive a propeller 24 through a bevel gear 22 and a propeller shaft 23 that are housed inside a gear case 21 disposed below the drive shaft housing 19.

The bracket device 16 is mainly formed of a swivel bracket 25 and a clamp bracket 26. The clamp bracket 26 is fixed to the transom 17*a* of the vessel body, while the swivel bracket 25 is secured to the outboard motor 11.

The swivel bracket 25 is pivotally supported through a tilting shaft 27 spanned between a pair of right and left clamp brackets 26 (see FIG. 4) so as to tilt vertically. A vertically extending pilot shaft 28 is rotatably supported inside the swivel bracket 25. A steering bracket 30 is rotatably provided on the upper end of the pilot shaft 28 positioned on the center line of the forward direction of the outboard motor 11 in a rotatable manner integrally with the pilot shaft 28.

A forward extending steering handle 31 is mounted on the front end of the steering bracket 30. A throttle grip 32 is fitted to the front end of the steering handle 31. When the steering handle 31 is swung in the transverse direction of the vessel body 17, the outboard motor 11 becomes steerable to the right and left based on the pilot shaft 28 with respect to the bracket device 16. In addition, the outboard motor 11 can be tilted and trimmed upward about the tilting shaft 27.

The outboard motor 11 is provided with a steering damper 33 in order to isolate a steersman from shocks exerted on the outboard motor 11 during steering.

Figure 4:
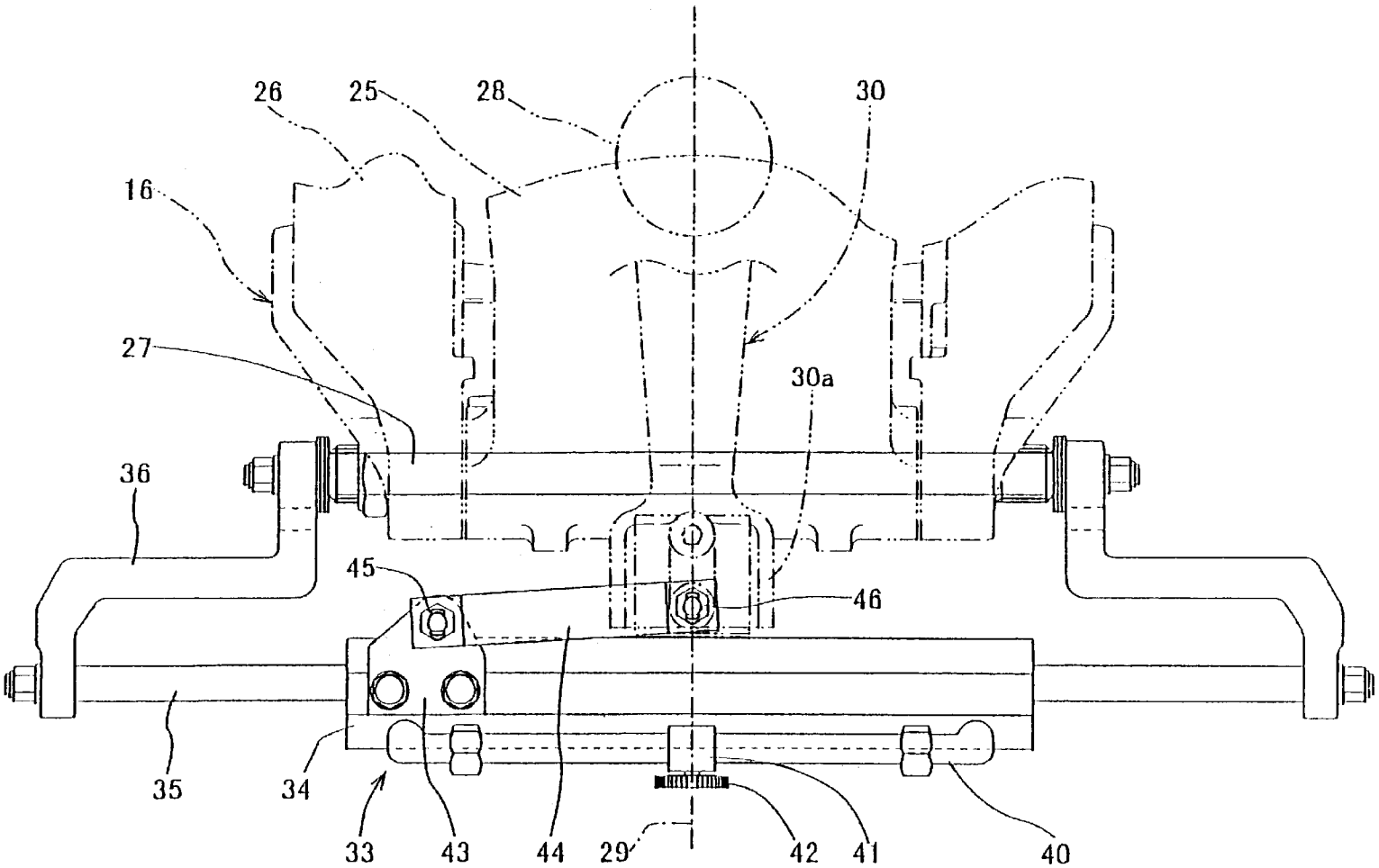
FIG. 4 is a plan view illustrating a steering damper.
Figure 5:
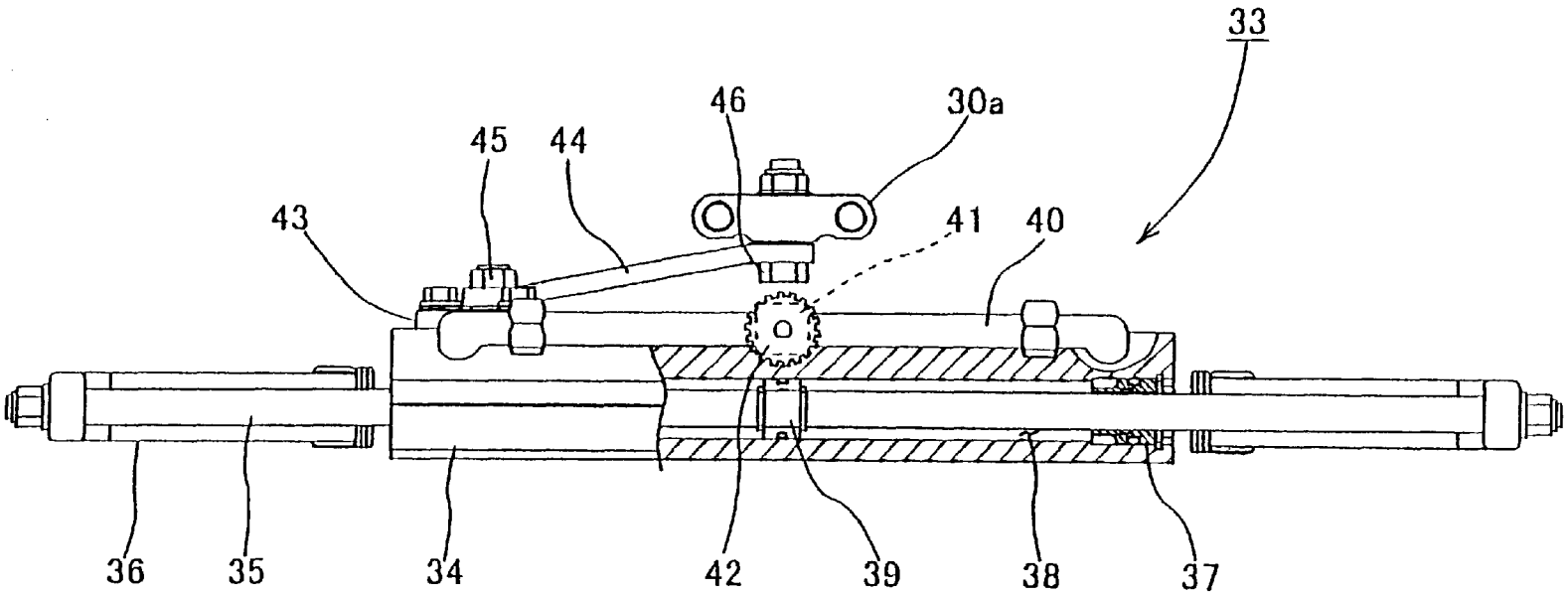
FIG. 5 is a partial cross-sectional front view showing the steering damper.
Figure 6:
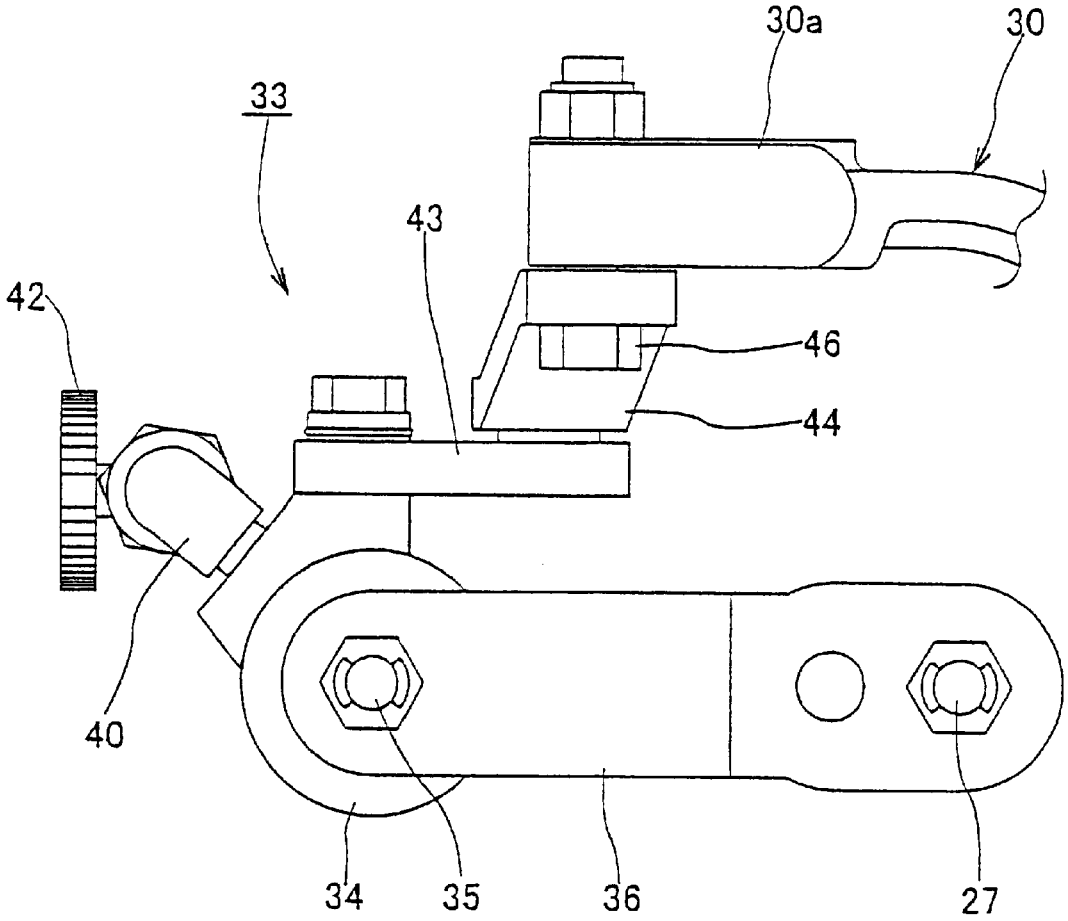
FIG. 6 is a left side view showing the steering damper.
Figure 7:
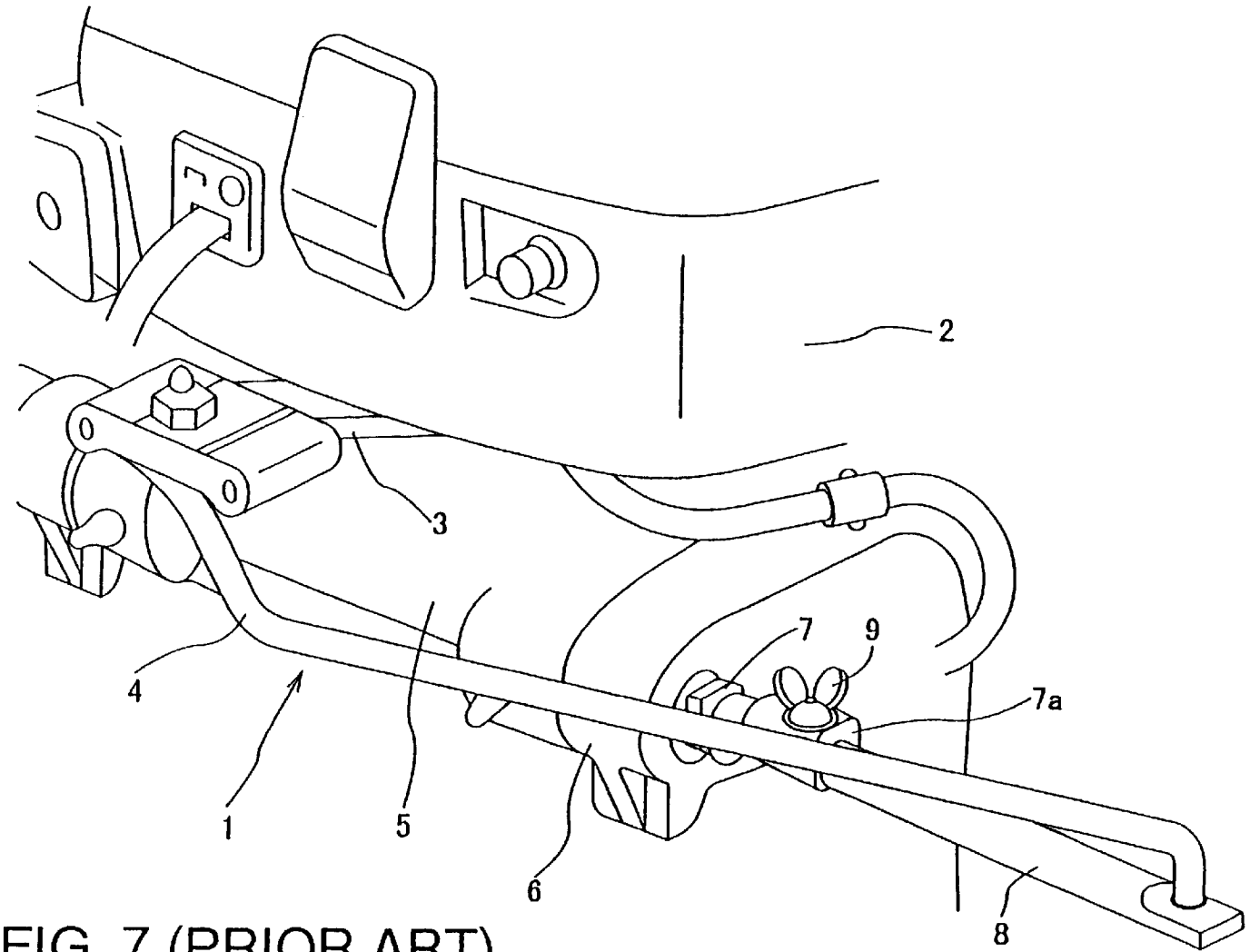
FIG. 7 (PRIOR ART)
FIG. 7 is a perspective view showing a conventional steering adjuster.

FIG. 4 is a plan view illustrating the steering damper 33. FIG. 5 is a partial cross-sectional front view showing the steering damper 33. FIG. 6 is a left side view showing the steering damper 33. The outboard motor 11 having the steering damper 33 mounted thereon is shown in FIGS. 1–3.

As illustrated in FIGS. 1–3, the steering damper 33 is positioned in front of the outboard motor 11, below a steering handle-mounting portion 30*a* of the steering bracket 30, and in front of the bracket device 16. As illustrated in FIGS. 4–6, the steering damper 33 includes a damper cylinder 34 positioned parallel to the tilting shaft 27, and a piston rod 35 which penetrates inside the damper cylinder 34, extends parallel to the tilting shaft 27, and protrudes outward from the damper cylinder 27 in the transverse direction.

Both ends of the piston rod 35 are fixed to one end of each of a pair of right and left piston rod holders 36. The other ends of the horizontally extending piston rod holder 36 are fixed to opposite sides of the bracket device 16 via the tilting shaft 27, together with the swivel bracket 25 and clamp bracket 26.

A piston stopper 37, which slidably supports the piston rod 35 and maintains the inside of the damper cylinder 34 watertight, closes the openings at both ends of the damper cylinder 34, thereby forming a fluid chamber 38 inside the damper cylinder 34.

In the fluid chamber 38, a damper piston 39 is disposed on the central portion of the piston rod 35 to partition the fluid chamber 38 into two right and left chambers. Each of the right and left fluid chambers 38 is filled with a fluid, e.g., damper oil (not shown). The damper fluid may be oil or any other fluid, such as a liquid or gas, for example, nitrogen.

The right and left fluid chambers communicate with each other through a bypass pipe 40 that is provided separately from the damper cylinder 34 at the forward upper side of the damper cylinder. In FIG. 5, when the piston rod 35 is moved, e.g., in a rightward direction or when the damper cylinder 34 is moved in a leftward direction, the damper fluid in the right fluid chamber 38 is caused to flow into the left fluid chamber 38 through the bypass pipe 40. The above described arrangement including the damper cylinder 34 and piston rod 35 with piston 39 constitutes a so called double acting fluid damper.

Although not shown in detail, as an alternative, the bypass pipe may be formed unitarily and in one piece with the damper cylinder.

A throttle valve 41 is provided substantially midway on the bypass pipe 40 at the forward upper side of the damper cylinder 34 on the centerline of the forward direction of the outboard motor. The throttle valve 41 imparts resistance to the damper fluid that flows in the bypass pipe 40, whereby damping action is generated. The throttle valve 41 is provided with an adjusting knob 42 for adjusting a flow resistance value to a selected value. The adjusting knob 42 faces forward, that is, the knob is disposed in a condition where the front surface is vertical.

Although not shown in detail, as an alternative, if the throttle valve is disposed on the damper piston without the bypass pipe, the structure is simplified. However, the flow resistance value cannot be externally regulated to an optional degree in this case.

On the top of the damper cylinder 34, a steering arm bracket 43 is provided so as to be offset toward one side from the centerline 29 of the forward direction of the outboard motor 11. One end of a steering arm 44, which has the shape of a rectangular plate in plan view, is pivotally attached to the steering arm bracket 43 by means of, e.g., a bolt 45 in a rotatable manner. The other end of the steering arm 44 is pivotally fitted to the lower portion of the steering handle-mounting portion 30*a* of the steering bracket 30 by means of, e.g., a bolt 46. The damper cylinder 34 and the steering bracket 30 are linked with each other through the steering arm 44.

Next, the operation of the present embodiment will be described.

As described above, the piston rod 35 is anchored to the vessel body 17 side together with the bracket device 16 by fixing opposite ends of the piston rod to both ends of the bracket device 16 by the tilting shaft 27 via the piston rod holders 36.

The damper cylinder 34 is disposed on the piston rod 35 so as to be slidable in the transverse direction of the outboard motor 11. The damper cylinder 34 and the steering bracket 30 fixed at the outboard motor 11 side are linked with each other through the steering arm 44.

When a steersman swings the steering handle 31 to the right or left, the outboard motor 11 is also steered to the right or left about the pilot shaft 28. Such steering of the outboard motor 11 causes the steering bracket 30 to rotate about the pilot shaft 28 to the right or left to slide the damper cylinder 34 in the transverse direction of the outboard motor 11 on the piston rod 35 via the steering arm 44.

When the damper cylinder 34 slides on the piston rod 35, the damper piston 39 provided at the center of the piston rod 35 causes the damper fluid to flow from one fluid chamber 38 to the other fluid chamber 38 via the bypass pipe 40.

The throttle valve 41 provided intermediate the ends of bypass pipe 40 imparts resistance to the flowing damper fluid inside the bypass pipe, thereby damper action is generated. Therefore, the steering damper 33 alleviates and absorbs shocks that are unexpectedly exerted on the outboard motor 11 during steering of the outboard motor 11. As a result, no shocks are transmitted to the steersman.

Since the damper cylinder 34 is disposed at the outboard motor 11 side, it is easier to attach and detach the outboard motor 11 to and from the vessel body 17. In addition, the use of hydraulic pressure or fluid in the steering damper 33 improves damper performance, and further maintains reliability without deterioration in the function even when external factors such as vibrations from the engine 13 are imposed on the steering damper 33.

Since the throttle valve 41 is disposed midway on the bypass pipe 40 to make a flow resistance value in the bypass pipe 40 variable, the damper performance can be set without steering performance being hindered according to the kind of outboard motor 11 as well as the steersman's skill and preference. As a result, the steerability of the steering structure is improved.

The adjusting knob 42 is disposed on the bypass pipe 40 on the center line 29 of the forward direction of the outboard motor 11 in front of and above the damper cylinder 34 so as to be vertically positioned at the front surface of the adjusting knob 42. This construction facilitates adjustments of the throttle valve 41.

The damper cylinder 34 and the steering bracket 30 fixed at the outboard motor 11 side are linked with each other through the steering arm 44. This construction prevents an increase in the number of parts and simplifies the steering structure of the outboard motor 11.

The bracket device 16 and the pair of horizontally extending piston rod holders 36 which support opposite ends of the piston rod 35 are clamped together. This construction makes the entirety compact, reduces the number of parts, and simplifies the steering structure.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present application claims priority under 35 U.S.C. §119 of Japanese Patent Application No. 2000-389234, filed on Dec. 21, 2000, the disclosure of which is expressly incorporated herein in its entirety.

What is claimed is:

1. A steering structure of an outboard motor mounted on a vessel body via a bracket device and rendered steerable in a transverse direction of the vessel body by a steering handle, comprising:

a tilting shaft positioned on the bracket device for pivotally supporting the outboard motor in a manner such that the outboard motor is vertically tiltable; and a steering damper disposed in front of the outboard motor, below a steering bracket having a steering handle-mounting portion, and in front of said bracket device, wherein said steering damper comprises a damper cylinder having openings at opposite ends thereof, said damper cylinder positioned parallel to said tilting shaft and a piston rod that extends through the inside of said damper cylinder, extends parallel to said tilting shaft, and protrudes outwardly from said damper cylinder at opposite ends thereof, said openings of said damper cylinder are each closed by a piston stopper, which slidably supports the piston rod and maintains the inside of the damper cylinder fluidtight, to form a fluid chamber inside said damper cylinder, a damper piston that partitions said fluid chamber into right and left fluid chambers is provided intermediate the ends of the piston rod positioned inside said fluid chamber, said right and left fluid chambers are intercommunicated by a bypass pipe, and a throttle valve is provided on said bypass pipe.

2. The steering structure according to claim 1, wherein said damper cylinder and said steering bracket are linked together through a steering arm.

3. The steering structure according to claim 2, wherein said throttle valve is disposed above said damper cylinder.

4. The steering structure according to claim 2, wherein said throttle valve is disposed in front of said damper cylinder, and said throttle valve is provided with an adjusting knob for varying a flow resistance value, said adjusting knob being disposed in a condition where a front surface thereof is perpendicular to a shaft portion thereof.

5. The steering structure according to claim 2, wherein said throttle valve is disposed on the centerline of a forward direction of the outboard motor.

6. The steering structure according to claim 1, wherein said throttle valve is disposed in front of said damper cylinder, and said throttle valve is provided with an adjusting knob for varying a flow resistance value, said adjusting knob being disposed in a condition where a front surface thereof is perpendicular to a shaft portion thereof.

7. The steering structure according to claim 6, wherein said throttle valve is disposed on the centerline of a forward direction of the outboard motor.

8. The steering structure according to claim 6, wherein said throttle valve is disposed above said damper cylinder.

9. The steering structure according to claim 1, wherein said throttle valve is disposed on the centerline of a forward direction of the outboard motor.

10. The steering structure according to claim 9, wherein said throttle valve is disposed above said damper cylinder.

11. The steering structure according to claim 1, wherein each end of said piston rod is fixed to one end of a pair of horizontally disposed right and left piston rod holders, the other ends of said pair of piston rod holders are disposed at opposite sides of said bracket device, and said piston rod holders and said bracket device are connected together on said tilting shaft.

12. A damping structure for a steering structure of an outboard motor, the steering structure including a steering handle mounting portion, and the outboard motor including a mounting bracket for mounting the outboard motor on a vessel, said damping structure comprising:

a double acting fluid damper operatively connected between the steering handle mounting portion and the mounting bracket, whereby the damper permits normal steering of the vessel by pivoting of the motor but alleviates and absorbs shocks that are exerted on the motor so that such shocks will not be transmitted to a steersman, said double acting fluid damper comprising:

(A) a damper cylinder having openings at opposite ends thereof, a piston rod that extends through the inside of said damper cylinder and protrudes outwardly from said damper cylinder at opposite ends thereof, said openings of said damper cylinder each being closed by a piston stopper, which slidably supports the piston rod and maintains the inside of the damper cylinder fluidtight thereby forming a fluid chamber inside said damper cylinder, and a damper piston that partitions said fluid chamber into right and left fluid chambers being provided intermediate the ends of the piston rod positioned inside said fluid chamber;

(B) a fluid provided within said fluid chamber;

(C) a bypass pipe interconnecting said right and left fluid chambers to permit fluid to pass between said right and left fluid chambers; and (D) a throttle valve provided on said bypass pipe to regulate the flow of fluid between the right and left chambers, said throttle valve being disposed above and in front of said damper cylinder, said throttle valve being provided with an adjusting knob for varying a flow resistance value, said adjusting knob being disposed in a condition where a front surface thereof extends generally vertically.

13. The damping structure according to claim 12, wherein each end of said piston rod is fixed to one end of a pair of horizontally disposed right and left piston rod holders, the other ends of said pair of piston rod holders being disposed at opposite sides of the mounting bracket.

14. The damping structure according to claim 12, wherein said fluid comprises one of a liquid and a gas.

15. The damping structure according to claim 14, wherein said liquid comprises oil.

16. The damping structure according to claim 14, wherein said gas comprises nitrogen.

17. A steering structure of an outboard motor mountable on a vessel body via a bracket device and rendered steerable in a transverse direction of the vessel body by a steering handle, said steering structure comprising:

a tilting shaft positioned on the bracket device for pivotally supporting the outboard motor in a manner such that the outboard motor is vertically tiltable; and a steering damper disposed in front of the outboard motor, below a steering bracket having a steering handle-mounting portion, and in front of said bracket device;

said steering damper comprises a damper cylinder having openings at opposite ends thereof, a piston rod extending through the inside of said damper cylinder and protruding outwardly from said damper cylinder at opposite ends thereof, said openings of said damper cylinder are each closed by a piston stopper, which slidably supports the piston rod and maintains the inside of the damper cylinder fluidtight to form a fluid chamber inside said damper cylinder, and a damper piston that partitions said fluid chamber into right and left fluid chambers is provided intermediate the ends of the piston rod positioned inside said fluid chamber;

a fluid provided within said fluid chamber; and a bypass pipe interconnecting said right and left fluid chambers to permit fluid to pass between said right and left fluid chambers.

18. The steering structure according to claim 17, further comprising a throttle valve provided on said bypass pipe to regulate the flow of fluid between the chambers.

19. The steering structure according to claim 17, wherein said damper cylinder and said steering bracket are linked together through a steering arm.

20. The steering structure according to claim 17, wherein said throttle valve is disposed in front of said damper cylinder, and said throttle valve is provided with an adjusting knob for varying a flow resistance value, said adjusting knob being disposed in a condition where a front surface thereof is generally vertical.

21. The steering structure according to claim 17, wherein said throttle valve is disposed on the centerline of a forward direction of the outboard motor.

22. The steering structure according to claim 17, wherein said throttle valve is disposed above said damper cylinder.

23. The steering structure according to claim 17, wherein each end of said piston rod is fixed to one end of a pair of horizontally disposed right and left piston rod holders, the other ends of said pair of piston rod holders are disposed at opposite sides of said bracket device, and said piston rod holders and said bracket device are connected together on said tilting shaft.

24. The steering structure according to claim 17, wherein said fluid comprises one of a liquid and a gas.

25. The steering structure according to claim 24, wherein said liquid comprises oil.

26. The steering structure according to claim 24, wherein said gas comprises nitrogen.

27. A damping structure for a steering structure of an outboard motor, the steering structure including a steering handle mounting portion, and the outboard motor including a mounting bracket for mounting the outboard motor on a vessel, said damping structure comprising:

a double acting fluid damper operatively connected between the steering handle mounting portion and the mounting bracket, whereby the damper permits normal steering of the vessel by pivoting of the motor but alleviates and absorbs shocks that are exerted on the motor so that such shocks will not be transmitted to a steersman, said double acting fluid damper comprising:

(A) a damper cylinder connected by an arm to the steering handle mounting portion, said damper cylinder having openings at opposite ends thereof, a piston rod that extends through the inside of said damper cylinder and protrudes outwardly from said damper cylinder at opposite ends thereof, said openings of said damper cylinder each being closed by a piston stopper, which slidably supports the piston rod and maintains the inside of the damper cylinder fluidtight thereby forming a fluid chamber inside said damper cylinder, and a damper piston that partitions said fluid chamber into right and left fluid chambers being provided intermediate the ends of the piston rod positioned inside said fluid chamber;

(B) a fluid provided within said fluid chamber; and (C) a bypass pipe interconnecting said right and left fluid chambers to permit fluid to pass between said right and left fluid chambers;

wherein each end of said piston rod is fixed to one end of a pair of horizontally disposed right and left piston rod holders, the other ends of said pair of piston rod holders being disposed at opposite sides of the mounting bracket.

28. The damping structure according to claim 27, further comprising a throttle valve provided on said bypass pipe to regulate the flow of fluid between the right and left chambers.

29. The damping structure according to claim 28, wherein said throttle valve is disposed in front of said damper cylinder, and said throttle valve is provided with an adjusting knob for varying a flow resistance value, said adjusting knob being disposed in a condition where a front surface thereof extends generally vertically.

30. The damping structure according to claim 28, wherein said throttle valve is disposed above said damper cylinder.

31. The damping structure according to claim 27, wherein said fluid comprises one of a liquid and a gas.

32. The damping structure according to claim 31, wherein said liquid comprises oil.

33. The damping structure according to claim 31, wherein said gas comprises nitrogen.

* * * * *